US010357781B2

(12) United States Patent
Luo

(10) Patent No.: US 10,357,781 B2
(45) Date of Patent: Jul. 23, 2019

(54) DUST COLLECTION DEVICE

(71) Applicant: CREATIVE TECHNOLOGY CORPORATION, Kawasaki-shi, Kanagawa (JP)

(72) Inventor: Li Luo, Kawasaki (JP)

(73) Assignee: CREATIVE TECHNOLOGY CORPORATION, Kawasaki-Shi, Kanagawa (JP)

( * ) Notice: Subject to any disclaimer, the term of this patent is extended or adjusted under 35 U.S.C. 154(b) by 324 days.

(21) Appl. No.: 15/329,497

(22) PCT Filed: Jul. 29, 2015

(86) PCT No.: PCT/JP2015/071569

§ 371 (c)(1),
(2) Date: Jan. 26, 2017

(87) PCT Pub. No.: WO2016/027635

PCT Pub. Date: Feb. 25, 2016

(65) Prior Publication Data

US 2017/0209871 A1 Jul. 27, 2017

(30) Foreign Application Priority Data

Aug. 18, 2014 (JP) ..... 2014-166053

(51) Int. Cl.
*B03C 3/36* (2006.01)
*B03C 3/70* (2006.01)
(Continued)

(52) U.S. Cl.
CPC ..... *B03C 3/366* (2013.01); *B03C 3/09* (2013.01); *B03C 3/38* (2013.01); *B03C 3/41* (2013.01); *B03C 3/47* (2013.01); *B03C 3/70* (2013.01)

(58) Field of Classification Search
CPC combination set(s) only.
See application file for complete search history.

(56) References Cited

U.S. PATENT DOCUMENTS 1,059,253 A * 4/1913 Wimbish ..... A01M 1/223 43/112
1,992,974 A * 3/1935 Thompson ..... B03C 3/155 209/127.1

(Continued)

FOREIGN PATENT DOCUMENTS

DE 1947075 A1 3/1971
DE 3513505 A1 11/1985

(Continued)

OTHER PUBLICATIONS

PCT, "International Search Report for International Application No. PCT/JP2015/071569".

(Continued)

*Primary Examiner* — Amber R Orlando
*Assistant Examiner* — Sonji Turner
(74) *Attorney, Agent, or Firm* — Manabu Kanesaka

(57) ABSTRACT

A dust collection device can be fitted to windows in a room, thus not only cleaning air while ventilating air within a space targeted for cleaning but also cleaning air outside of the space. A dust collection device is constructed by laminating first insulation type electrodes and second insulation type electrodes alternately via spacers. The insulation type electrodes have a configuration in which both sides of first electrodes (second electrodes) are coated by first insulating layers (second insulating layers). Furthermore, a power supply is connected to the electrodes, and the electrodes are grounded. In addition, a plurality of first through holes (second through holes) is provided in rows in the insulation type electrodes. Furthermore, the positions of the through holes in the insulation type electrodes are arranged in a plane view so as to be a prescribed distance from the positions of the through holes in the insulation type electrodes.

7 Claims, 12 Drawing Sheets

(51) Int. Cl.

| | |
|---|---|
| ***B03C 3/41*** | (2006.01) |
| ***B03C 3/47*** | (2006.01) |
| ***B03C 3/09*** | (2006.01) |
| ***B03C 3/38*** | (2006.01) |

(56) References Cited

U.S. PATENT DOCUMENTS 2,080,242 A * 5/1937 Ward ..... A01M 1/223 43/112
2,696,893 A * 12/1954 Richardson ..... A01M 1/223 43/112
3,581,462 A * 6/1971 Stump ..... B03C 3/155 323/242
3,735,560 A * 5/1973 Wellman ..... B03C 3/155 323/242
4,313,741 A * 2/1982 Masuda ..... B03C 3/12 96/78
4,652,281 A * 3/1987 Masuda ..... B03C 3/60 206/518
5,137,552 A * 8/1992 Sasaki ..... B03C 3/45 96/80
5,376,168 A * 12/1994 Inculet ..... A47L 9/12 15/1.51
5,492,557 A * 2/1996 Vanella ..... B03C 3/017 422/121
5,614,002 A * 3/1997 Chen ..... B03C 3/09 96/55
5,766,318 A * 6/1998 Loreth ..... B03C 3/12 96/69
5,993,520 A * 11/1999 Yu ..... A47L 9/122 96/66
6,126,722 A * 10/2000 Mitchell ..... B03C 3/09 361/226
6,679,940 B1 * 1/2004 Oda ..... A61L 9/22 96/55
7,267,712 B2 * 9/2007 Chang ..... G03G 21/1867 399/90
7,294,176 B2 * 11/2007 Kim ..... B01D 53/32 96/69
7,438,747 B2 * 10/2008 Luo ..... H01T 23/00 361/226
7,465,338 B2 * 12/2008 Kurasek ..... B03C 3/09 95/75
7,485,174 B2 * 2/2009 Wang ..... B03C 3/09 95/75
7,507,275 B2 * 3/2009 Kim ..... B03C 3/017 361/230
7,543,546 B2 * 6/2009 Shibata ..... H01J 37/32009 118/723 E
8,323,385 B2 * 12/2012 Nutsos ..... B03C 3/08 96/69
8,349,052 B2 * 1/2013 Noh ..... B03C 3/025
8,470,084 B2 * 6/2013 Ji ..... B03C 3/08 313/355
8,498,092 B2 * 7/2013 Itani ..... A01M 1/223 43/112
8,512,455 B2 * 8/2013 Yasuhiko ..... B03C 3/86 96/69
8,580,017 B2 * 11/2013 Noh ..... B03C 3/08 96/69
2006/0115291 A1 * 6/2006 Chung ..... G03G 21/1867 399/90
2010/0132562 A1 * 6/2010 Noh ..... B03C 3/86 96/69
2011/0113963 A1 5/2011 Wu et al.
2014/0352535 A1 12/2014 Oertmann
2015/0075379 A1 3/2015 Vanella
2017/0341087 A1 * 11/2017 Yuge ..... B03C 3/025

FOREIGN PATENT DOCUMENTS

| | | | |
|---|---|---|---|
| FR | 2907843 | A1 | 5/2008 |
| JP | S58-163456 | A | 9/1983 |
| JP | S62-35645 | U | 3/1987 |
| JP | H06-63444 | A | 3/1994 |
| JP | H06-238194 | A | 8/1994 |
| JP | H07-80349 | A | 3/1995 |
| JP | 2010-63964 | A | 3/2010 |
| WO | 01/064349 | A1 | 9/2001 |
| WO | 2013/023644 | A1 | 2/2013 |
| WO | 2013/153563 | A1 | 10/2013 |
| WO | 2014/119349 | A1 | 8/2014 |

OTHER PUBLICATIONS

Europe Patent Office, "Search Report for European Patent Application No. 15834557.9," dated Aug. 28, 2017.

* cited by examiner

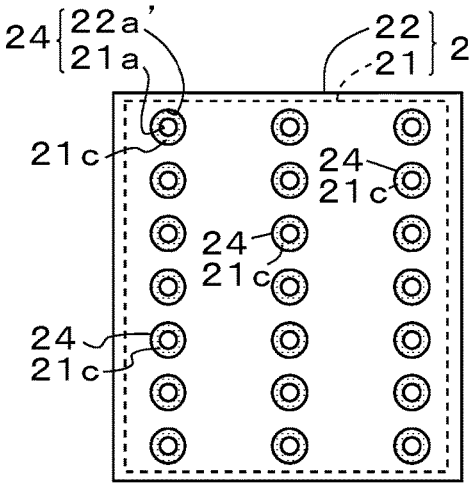
Fig. 9(a)
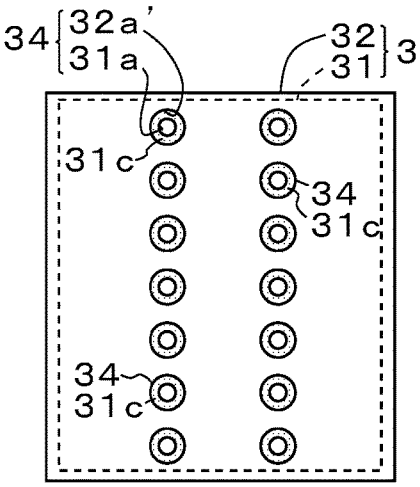
Fig. 9(b)
Fig. 10
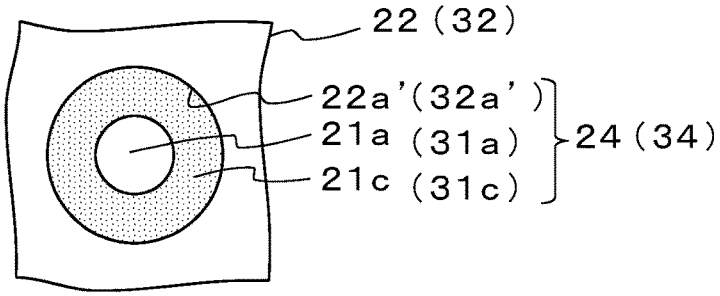

Fig. 11
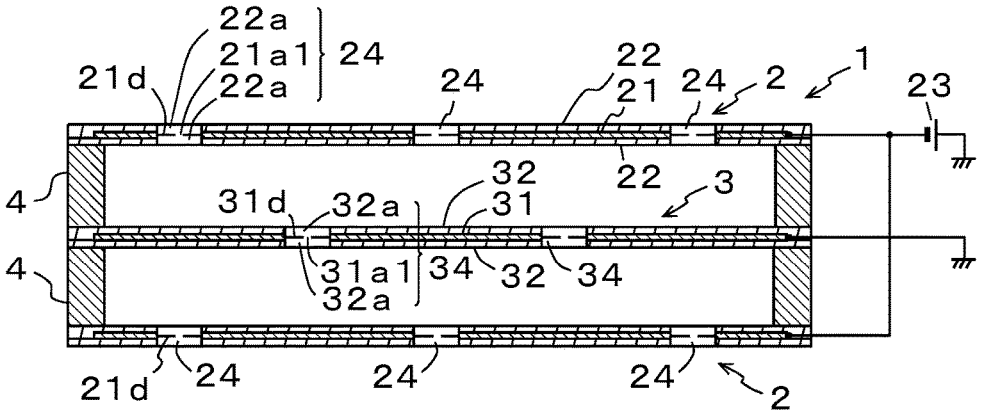
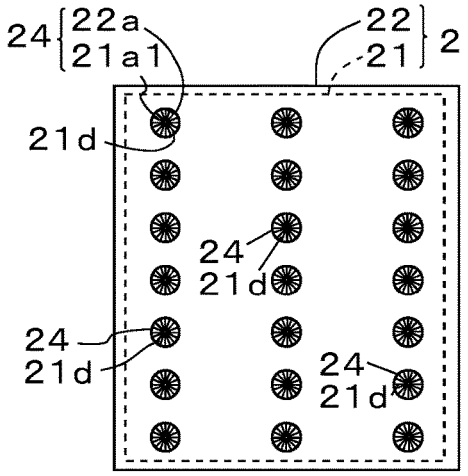
Fig. 12(a)
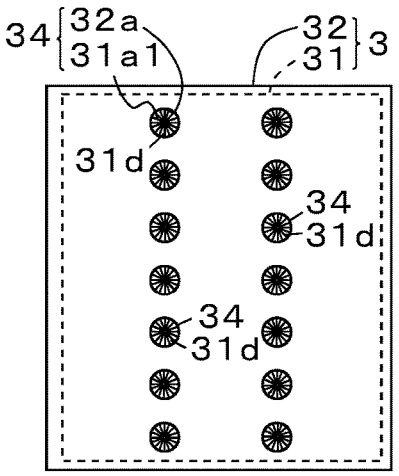
Fig. 12(b)

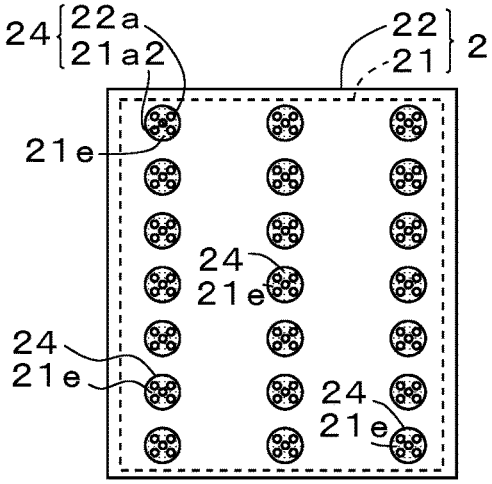
Fig. 15(a)
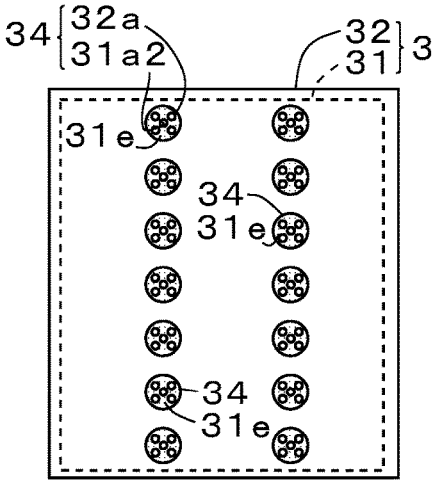
Fig. 15(b)
Fig. 16
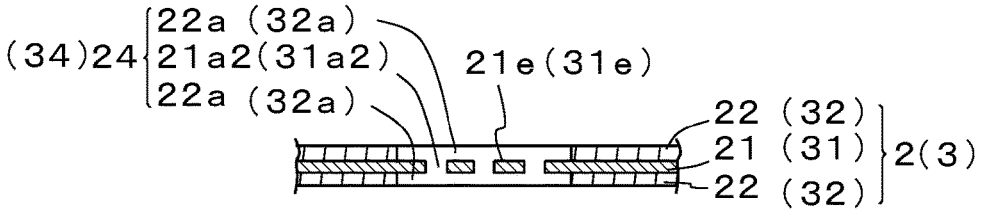
Fig. 17
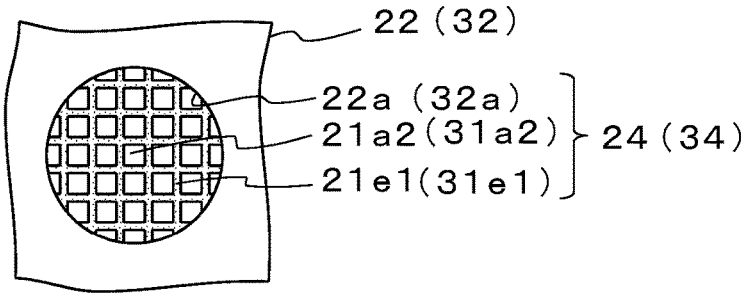

DUST COLLECTION DEVICE

TECHNICAL FIELD

The present invention relates to a dust collection device to eliminate dust in a gaseous body such as air.

BACKGROUND ART

Conventionally, as a dust collection device of this kind, for example, a technology is described in Patent Literature 1.

This dust collection device is a technology in which, after dust is electrically charged by discharge in an ionization unit in a preceding stage, an electric field is formed by alternately applying different voltages to laminated electrode plates in a dust collection unit in a subsequent stage, and the dust electrically charged in the ionization unit is collected by this dust collection unit.

However, in this dust collection device, an ionization unit that has a complicated structure and easily malfunctions must be provided in a preceding stage of the dust collection unit, so that the dust collection device lacks operation reliability.

Therefore, like the technology described in Patent Literature 2, a dust collection device with reliability enhanced by omitting the ionization unit has been proposed.

This dust collection device has a configuration in which a dust collection unit is constructed by alternately laminating a complete insulation type earth electrode formed by coating an entire earth electrode made of a sheet-shaped conductor by a sheet-shaped insulating layer and a voltage application electrode made of a sheet-shaped conductor while sandwiching an insulative corrugated sheet, and a silicone polymer film is provided on the entire dust collection unit.

Accordingly, by flowing air containing dust into a space between the complete insulation type earth electrode and the voltage application electrode, dust in the air can be attracted by either of the electrodes.

CITATION LIST

Patent Literature

Patent Literature 1: International Publication No. 2001/064349

Patent Literature 2: Japanese Application Laid-Open No. 2010-063964

SUMMARY OF THE INVENTION

Technical Problems

However, the above-described conventional technologies have the following problems.

The conventional dust collection device is structured so that air containing dust is flowed into a space between a complete insulation type earth electrode and a voltage application electrode and attracted by either of the electrodes. That is, the conventional dust collection device is structured to collect dust by suctioning it from a thickness direction of the dust collection device, so that it is difficult to install the dust collection device in accordance with a window, etc., in a room. Therefore, the dust collection device has to be installed inside an enclosed space, and it cleans only the air in the space. In addition, the same air in the enclosed space is repeatedly circulated inside the dust collection device, so that oxygen inside the space may decrease over time.

The present invention was made to solve the above-described problems, and an object thereof is to provide a dust collection device that can be installed in accordance with a window, etc., in a room by being structured to suction a gaseous body such as air from one surface of the sheet-shaped device and exhaust it from the other surface, and as a result, can clean not only air in a space to be cleaned but also air outside the space while ventilating the air in the space to be cleaned.

Solution to the Problems

In order to solve the above-described problems, the invention of the first aspect is a dust collection device constructed by laminating a first insulation type electrode including a sheet-shaped first electrode at least one surface of which is coated by a first insulating layer and to which a first voltage is applied, and a second insulation type electrode including a sheet-shaped second electrode at least one surface of which is coated by a second insulating layer and to which a second voltage different from the first voltage is applied, alternately via an insulating spacer, wherein a plurality of first ventilation holes penetrating from the first insulating layer to the first electrode and exposing a part of the first electrode inside, are provided in the first insulation type electrode, a plurality of second ventilation holes penetrating from the second insulating layer to the second electrode and exposing a part of the second electrode inside, are provided in the second insulation type electrode, and the second ventilation holes are disposed so that their positions deviate by a predetermined distance from positions of the first ventilation holes in a planar view.

With this construction, when the first voltage is applied to the first electrode of the first insulation type electrode and the second voltage is applied to the second electrode of the second insulation type electrode, a potential difference occurs between the first electrode and the second electrode, and the first electrode and the second electrode are electrically charged with polarities reverse to each other. In addition, near the first electrode exposed inside the first ventilation hole and near the second electrode exposed inside the second ventilation hole, a high-density electric field is generated, and so-called corona discharge occurs near the first electrode exposed inside the first ventilation hole and near the second electrode exposed inside the second ventilation hole. Therefore, when air containing dust passes through, for example, the first ventilation hole of the first insulation type electrode on the front surface, the dust is electrically charged by corona discharge occurring near the first electrode exposed inside the first ventilation hole.

The electrically charged dust flows into the dust collection device together with air.

At this time, the second ventilation holes of the second insulation type electrode deviate by a predetermined distance from the first ventilation holes, so that the air and dust flowing into the portion between the first insulation type electrode and the second insulation type electrode move in a lateral direction from the first ventilation holes toward the second ventilation holes, and flow into the portion between the second insulation type electrode and the first insulation type electrode via the second ventilation holes. At this time, dust that is not electrically charged by corona discharge near the first electrode exposed inside the first ventilation hole is electrically charged by corona discharge near the second electrode exposed inside the second ventilation hole.

Thereafter, in the same manner, air containing electrically charged dust flows while meandering inside the device.

Thus, when air containing electrically charged dust flows inside the dust collection device, dust electrically charged with a polarity reverse to the charging polarity of the first electrode is electrostatically attracted to the first electrode side, dust electrically charged with a polarity reverse to the charging polarity of the second electrode is electrostatically attracted to the second electrode side, and only clean air is flowed out of the dust collection device. Further, since air flows while meandering inside the device as described above, a time of flow inside the device becomes longer, and accordingly, a larger amount of dust is reliably electrostatically attracted.

If the position of the first electrode exposed inside the first ventilation hole and the position of the second electrode exposed inside the second ventilation hole are close to each other, spark discharge may occur between the first electrode and the second electrode before corona discharge occurs. However, in the dust collection device according to this invention, the first electrode exposed inside the first ventilation hole and the second electrode exposed inside the second ventilation hole are positioned to deviate by a predetermined distance from each other, so that spark discharge hardly occurs between these electrodes.

The dust collection device described above can be constructed by laminating a first insulation type electrode including a sheet-shaped first electrode and a first insulating layer coating the first electrode and a second insulation type electrode including a sheet-shaped second electrode and a second insulating layer coating the second electrode alternately via a thin spacer, so that the dust collection device can be entirely formed into a sheet shape that is lightweight and thin, and does not require a large space. As a result, maintenance of the device, such as washing out contamination on the device, can be easily performed.

Further, as described above, the dust collection device is structured to collect dust by suctioning air containing the dust in a surface direction of the dust collection device, so that the device can be installed in accordance with a window, etc., in a room.

For example, it is possible that two dust collection devices are fitted in accordance with a window frames provided in a room as an enclosed space, and after outside air is flowed into the room space via one dust collection device, the air can be flowed out of the room space from the other dust collection device to the outside. That is, outside air is cleaned and guided into a room space by one dust collection device, and inside air is cleaned and exhausted to the outside by the other dust collection device, so that the dust collection device can clean air in the room while ventilating it. Cleaned air is exhausted to the outside, so that air outside the room space can also be cleaned. In addition, since fresh air is supplied into the room space, oxygen inside the room can be prevented from decreasing.

This dust collection device does not need an ionization unit that has a complicated structure and easily malfunctions, so that the device has high operation reliability.

The invention of the second aspect is the dust collection device according to the first aspect, constructed so that the first electrode inside the first ventilation hole is exposed in a donut shape as viewed from the first insulating layer side, and the second electrode inside the second ventilation hole is exposed in a donut shape as viewed from the second insulating layer side.

With this construction, by the donut-shaped exposed portion, a contact area between air and the first and second electrodes is enlarged, so that the capacity for electrically charging dust of the first electrode exposed inside the first ventilation hole and the second electrode exposed inside the second ventilation hole is improved.

The invention of the third aspect is the dust collection device according to the first aspect, constructed so that the first electrode inside the first ventilation hole is formed into a brush-shaped electrode made of conductive fibers directed toward a center side from an inner circumference of the first ventilation hole, and the second electrode inside the second ventilation hole is formed into a brush-shaped electrode made of conductive fibers directed toward a center side from an inner circumference of the second ventilation hole.

With this construction, by the exposure in the brush shape, a contact area between air and the first and second electrodes is enlarged. In addition, the holes of the first and second electrodes through which air passes become small, so that dust with a large diameter cannot pass through the first and second ventilation holes.

The invention of the fourth aspect is the dust collection device according to the first aspect, constructed so that a plurality of small holes communicating with the holes of the first insulating layer are formed in the first electrode inside the first ventilation hole, and a plurality of small holes communicating with the holes of the second insulating layer are formed in the second electrode inside the second ventilation hole.

With this construction, dust with a large diameter is blocked by the small holes of the first and second ventilation holes.

The invention of the fifth aspect is the dust collection device according to any of the first to fourth aspects, constructed so that both surfaces of the first electrode of the first insulation type electrode are coated by the first insulating layers, both surfaces of the second electrode of the second insulation type electrode are coated by the second insulating layers, the first ventilation holes penetrate across the first insulating layers and the first electrode in a state that a part of the first electrode is exposed inside, and the second ventilation holes penetrate across the second insulating layers and the second electrode in a state that a part of the second electrode is exposed inside.

The invention of the sixth aspect is the dust collection device according to any of the first to fifth aspects, constructed so that the first voltage with a positive potential or a negative potential is applied to the first electrode, and the second voltage with zero potential is applied to the second electrode.

The invention of seventh aspect is the dust collection device according to any of the first to sixth aspects, constructed so that each of the second ventilation holes is disposed so as to be positioned at substantially the center between two first ventilation holes adjacent to each other provided in the first insulation type electrode in a planar view.

Effects of the Invention

As described in detail hereinbefore, since the dust collection device of the present invention is structured to collect dust by suctioning air containing the dust in a surface direction of the dust collection device, so that an excellent effect of installing the dust collection device in accordance with a window, etc., in a room is obtained. As a result, by fitting a plurality of dust collection devices to a plurality of windows provided in a room as an enclosed space, an effect of cleaning air in the space while ventilating it is obtained. Since fresh air is supplied into the room space, an effect of securing fresh oxygen in the room space and preventing a decrease in oxygen in the room space is obtained. In addition, unwanted contaminants, water vapor, and odors in a room space can be eliminated.

Further, the entire dust collection device can be formed into a sheet shape that is lightweight and thin, and does not require a large space, so that an effect of easily performing maintenance such as washing is obtained.

In addition, since the first electrode exposed inside the first ventilation hole and the second electrode exposed inside the second ventilation hole are disposed to deviate by a predetermined distance from each other, so that an effect of preventing spark discharge between these electrodes is obtained.

Since the device does not need an ionization unit that has a complicated structure and easily malfunctions, an effect of providing a downsized and thin dust collection device that has high operation reliability and includes a small number of components is obtained.

The invention of the second aspect brings about an effect of improving dust attraction capacity of the device.

The invention of the third and fourth aspects brings about an effect of not only improving the capacity of the device for electrically charging dust but also reliably eliminating dust with a large diameter.

BRIEF DESCRIPTION OF THE DRAWINGS

FIG. 9 are plan views of insulation type electrodes, FIG. 9(*a*) shows a first insulation type electrode and FIG. 9(*b*) shows a second insulation type electrode.

FIG. 10 is a partial enlarged view of first and second ventilation holes to be applied to the second embodiment.

FIG. 11 is a sectional view showing a dust collection device according to a third embodiment of the present invention.

FIG. 12 are plan views of insulation type electrodes, FIG. 12(*a*) shows a first insulation type electrode and FIG. 12(*b*) shows a second insulation type electrode.

FIG. 15 are plan views of insulation type electrodes, FIG. 15(*a*) shows a first insulation type electrode and FIG. 15(*b*) shows a second insulation type electrode.

FIG. 16 is a partial sectional view showing a modification relating to the ventilation holes of the insulation type electrode.

FIG. 17 is a partial sectional view showing another modification relating to the ventilation holes of the insulation type electrode.

DESCRIPTION OF THE EMBODIMENTS

Hereinafter, best modes of the present invention will be described with reference to the drawings.

First Embodiment

Figure 1:
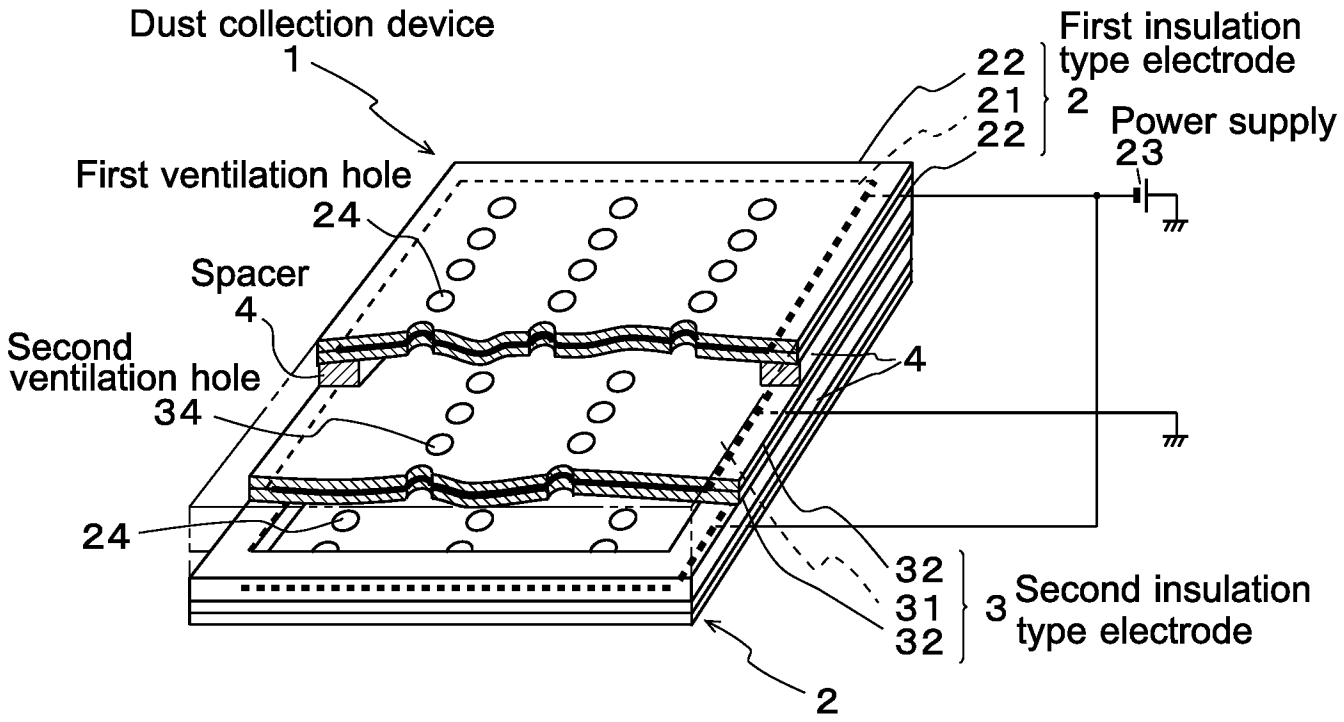
FIG. 1 is a partially cutaway perspective view of a dust collection device according to a first embodiment of the present invention.
Figure 2:
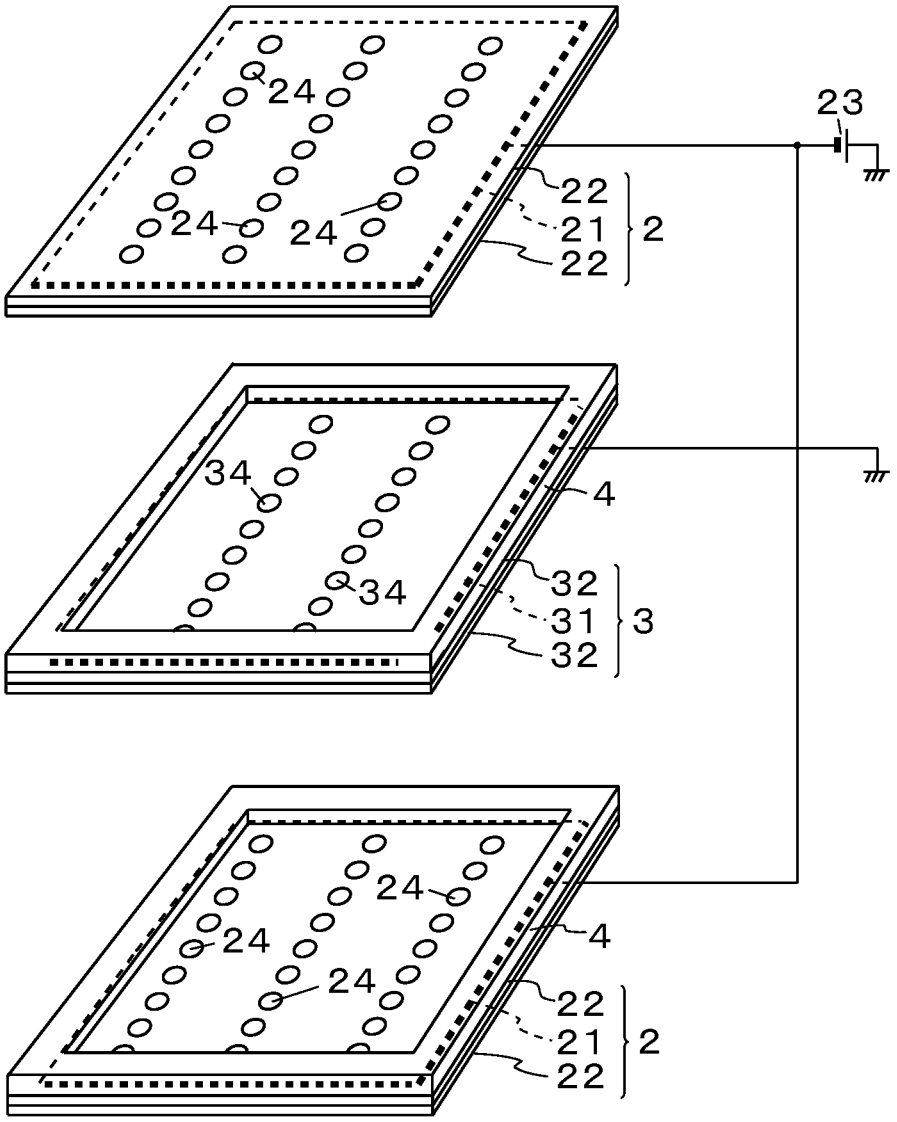
FIG. 2 is an exploded perspective view of the dust collection device according to the first embodiment.
Figure 3:
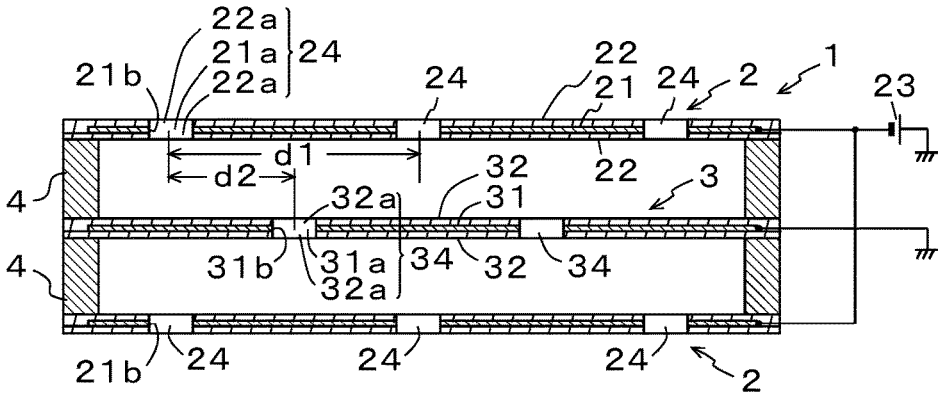
FIG. 3 is a sectional view of the dust collection device.

FIG. 1 is a partially cutaway perspective view of a dust collection device according to a first embodiment of the present invention. FIG. 2 is an exploded perspective view of the dust collection device according to the first embodiment. FIG. 3 is a sectional view of the dust collection device.

As shown in FIG. 1, the dust collection device 1 is structured by laminating first insulation type electrodes 2 and a second insulation type electrode 3 alternately via insulating spacers 4.

Specifically, in this embodiment, as shown in FIG. 2, two first insulation type electrodes 2 and one second insulation type electrode 3 are laminated alternately. In this case, by interposing a spacer 4 having a quadrilateral frame shape between the second insulation type electrode 3 and the upper first insulation type electrode 2, and interposing a similar spacer 4 between the second insulation type electrode 3 and the lower first insulation type electrode 2, a space corresponding to a thickness of the spacer 4 is formed between the first insulation type electrode 2 and the second insulation type electrode 3, and the space between the first insulation type electrode 2 and the second insulation type electrode 3 is kept airtight.

The first insulation type electrode 2 is a sheet-shaped electrode formed by coating both surfaces of a sheet-shaped first electrode 21 by first insulating layers 22.

Figure 4:
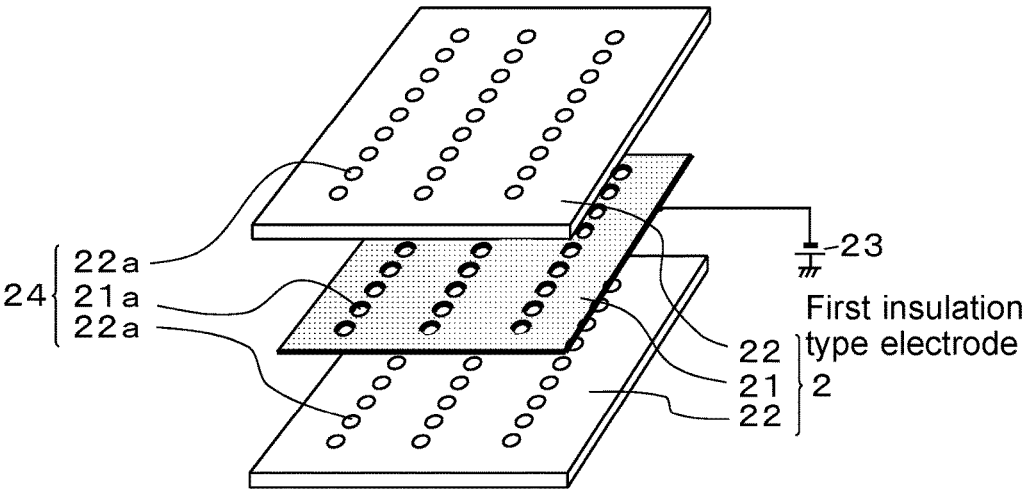
FIG. 4 is an exploded perspective view of a first insulation type electrode.

FIG. 4 is an exploded perspective view of the first insulation type electrode 2.

As shown in FIG. 4, in the first insulation type electrode 2 of the present embodiment, the first electrode 21 is formed on the lower first insulating layer 22, and the upper first insulating layer 22 is laminated on the first electrode 21 so as to coat the entire first electrode 21. The first electrode 21 is made by forming a conductive material such as a metal, carbon, a conductive oxide or a conductive organic substance into a foil shape or a film shape. The first insulating layer 22 is made by forming a flexible insulating material such as paper, nonwoven cloth, resin, or ceramic paper into a sheet shape.

Then, a negative terminal of a direct current power supply 23 having a grounded positive terminal is connected to the first electrode 21, and a negative voltage as a first voltage is applied to the first electrode 21. In this embodiment, "−6 kV" is applied as the first voltage.

As shown in FIG. 3 and FIG. 4, in this first insulation type electrode 2, first ventilation holes 24 are provided in three rows so as to penetrate from one first insulating layer 22 to the other first insulating layer 22 via the first electrode 21.

Specifically, each first ventilation hole 24 consists of a hole 22*a* opened in the upper first insulating layer 22, a hole 21*a* opened in the first electrode 21, and a hole 22*a* opened in the lower first insulating layer 22, and bore diameters of the holes 21*a* and 22*a* are set equal to each other. Accordingly, inside each first ventilation hole 24, a section 21*b* of the first electrode 21 is exposed on an inner circumferential surface of the first ventilation hole 24.

On the other hand, the second insulation type electrode 3 is a sheet-shaped electrode formed by coating both surfaces of a sheet-shaped second electrode 31 by second insulating layers 32.

Figure 5:
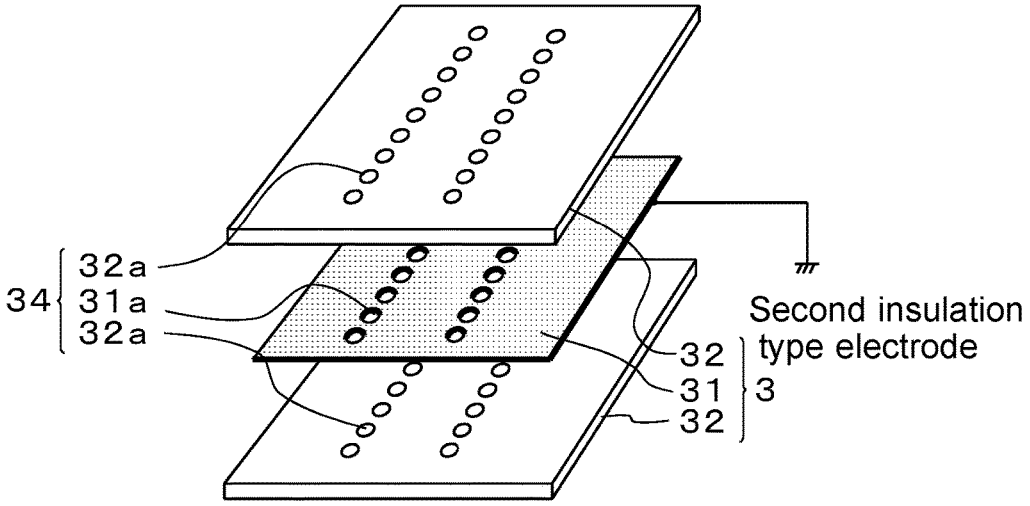
FIG. 5 is an exploded perspective view of a second insulation type electrode.

FIG. 5 is an exploded perspective view of the second insulation type electrode 3.

As shown in FIG. 5, also in this second insulation type electrode 3, a second electrode 31 is formed on the lower second insulating layer 32, and the upper second insulating layer 32 is laminated on the second electrode 31 so as to coat the entire second electrode 31. The second electrode 31 is obtained by forming the same material as the first electrode 21 into the same shape as the first electrode 21, and the second insulating layer 32 is also obtained by forming the same insulating material as the first insulating layer 22 into a sheet shape.

The second electrode 31 is grounded, and a zero voltage as the second voltage is applied to the second electrode 31.

As shown in FIG. 3 and FIG. 5, in this second insulation type electrode 3, second ventilation holes 34 are provided in two rows so as to penetrate from the upper second insulating layer 32 to the lower second insulating layer 32 via the second electrode 31.

These second ventilation holes 24 also have the same size and the same shape as those of the first ventilation holes 24, and each consists of a hole 32*a* opened in one second insulating layer 32, a hole 31*a* opened in the second electrode 31, and a hole 32*a* opened in the other second insulating layer 32, and a section 31*b* of the second electrode 31 is exposed on an inner circumferential surface of the second ventilation hole 34.

The second ventilation hole 34 described above is disposed so that its position deviates by a predetermined distance from the position of the first ventilation hole 24 of the first insulation type electrode 2 in a planar view. Specifically, as shown in FIG. 3, a plurality of first ventilation holes 24 are provided adjacent to each other at a distance d1, and each second ventilation hole 34 is provided at a distance d2 (=d1/2) from one first ventilation hole 24. Accordingly, each of the second ventilation holes 34 is positioned at substantially the center between two first ventilation holes 24 adjacent to each other.

Areas of the first insulation type electrode 2 and the second insulation type electrode 3 described above are properly set according to a use situation of the dust collection device 1, and in this embodiment, a thickness of each first insulating layer 22 (second insulating layer 32) of the first insulation type electrode 2 (second insulation type electrode 3) is set to 20 μm to 300 μm, a thickness of the spacer 4, that is, a distance between the first insulation type electrode 2 and the second insulation type electrode 3 is set between 0.3 mm and 5 mm. A diameter of each first ventilation hole 24 (second ventilation hole 34) is set to a value between 0.1 mm and 5 mm, and a distance between first ventilation holes 24 and 24 (second ventilation holes 34 and 34) adjacent to each other is set to a value between 10 mm to 60 mm.

Next, operation and effects of the dust collection device 1 of this embodiment are described.

Figure 6:
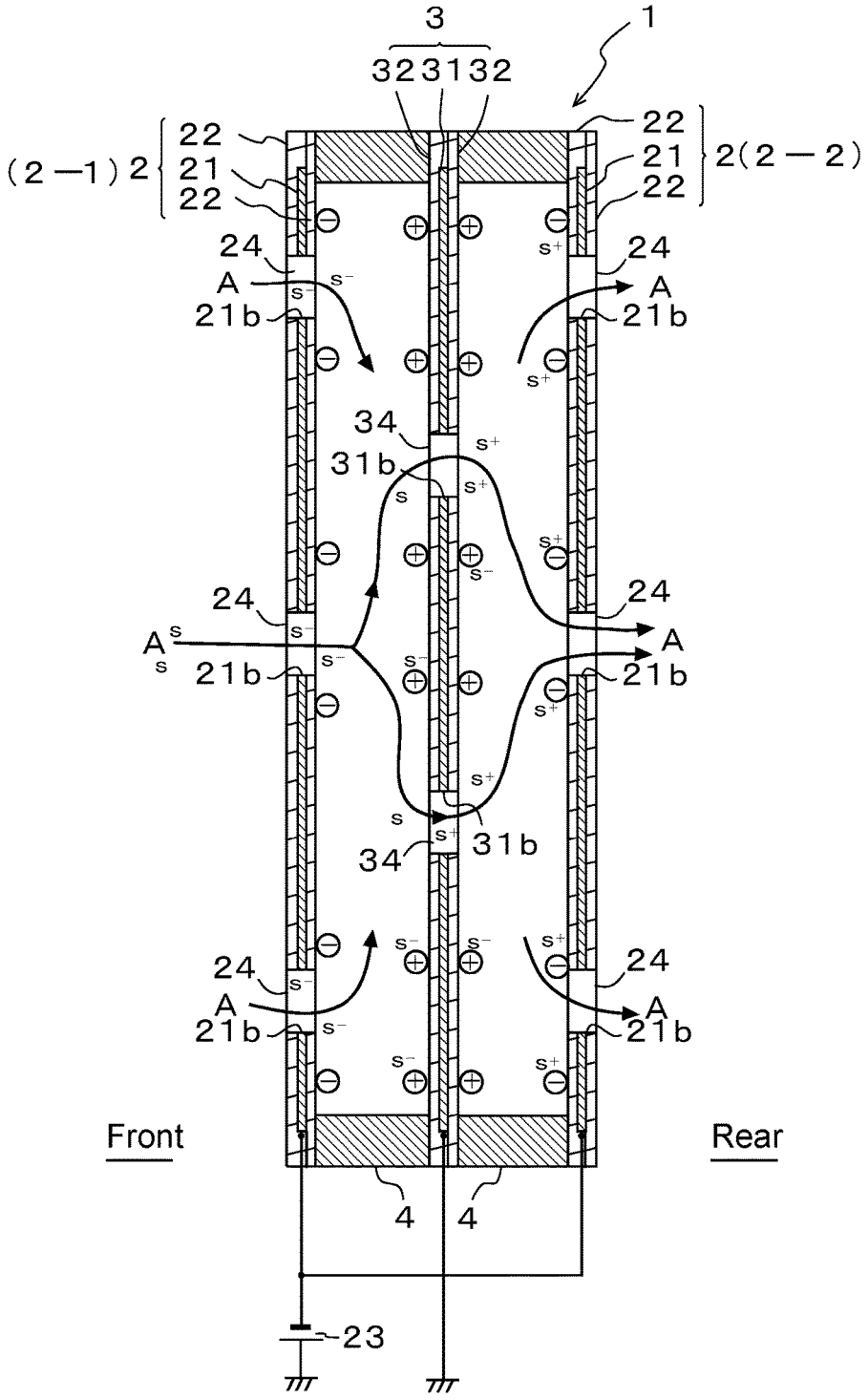
FIG. 6 is a sectional view describing operation and effects of the dust collection device.

FIG. 6 is a sectional view describing operation and effects of the dust collection device 1.

In FIG. 6, when the direct current power supply 23 is turned on, a potential of the first electrode 21 of the first insulation type electrode 2 reaches −6 kV, a potential of the second electrode 31 of the second insulation type electrode 3 reaches 0 kV, and a potential difference of 6 kV occurs between the first electrode 21 and the second electrode 31. As a result, negative corona discharge occurs near the section 21*b* of the first electrode 21 of the first insulation type electrode 2, and positive corona discharge occurs near the section 31*b* of the second electrode 31 of the second insulation type electrode 3.

In this state, when air A containing dust s is flowed via the plurality of first ventilation holes 24 of the front (left in FIG. 6) first insulation type electrode 2-1, due to negative corona discharge, the dust s is electrically charged with negative polarity, and the air A containing the dust s electrically charged with negative polarity enters the space between the first insulation type electrode 2-1 and the second insulation type electrode 3.

Then, the dust s electrically charged with negative polarity is electrostatically attracted to a front surface (left surface in FIG. 6) of the second insulating layer 32 in the second insulation type electrode 3 electrically charged with positive polarity.

Thereafter, the air A passes through the plurality of second ventilation holes 34 of the second insulation type electrode 3, and at this time, dust s that was not electrically charged by negative corona discharge in the first ventilation holes 24 is electrically charged with positive polarity by positive corona discharge in the second ventilation holes 34, and enters the space between the second insulation type electrode 3 and the first insulation type electrode 2-2 together with the air A.

Then, the dust s electrically charged with positive polarity is electrostatically attracted to the front surface of the first insulating layer 22 in the first insulation type electrode 2-2 electrically charged with negative polarity. The dust s with negative polarity that was not electrostatically attracted to the front surface of the second insulating layer 32 electrically charged with positive polarity but flowed into the space between the second insulation type electrode 3 and the first insulation type electrode 2-2 is electrostatically attracted to the rear surface of the second insulating layer 32.

Thereafter, the air A from which dust s has been removed flows out to the outside from the plurality of first ventilation holes 24 of the rear first insulation type electrode 2-2.

At this time, since the second ventilation holes 34 of the second insulation type electrode 3 deviate from the first ventilation holes 24 by a distance d2 (refer to FIG. 3), air containing the dust s flows into the space between the first insulation type electrode 2-1 and the second insulation type electrode 3, and then moves in a lateral direction from the first ventilation holes 24 toward the second ventilation holes 34, and flows into the space between the second insulation type electrode 3 and the first insulation type electrode 2-2 via the second ventilation holes 34. That is, the air A flows while meandering inside the dust collection device 1, and flows out of the device from the plurality of first ventilation holes 24 of the rear first insulation type electrode 2-2. Therefore, the air A containing the dust s flows while meandering inside the dust collection device 1, so that the time of staying inside the dust collection device 1 lengthens, and accordingly, most of the dust s contained in the air A is reliably electrostatically attracted by the first insulation type electrodes 2 and the second insulation type electrode 3.

If a position of a section 21*b* of the first electrode 21 exposed inside the first ventilation hole 24 and a position of a section 31*b* of the second electrode 31 exposed inside the second ventilation hole 34 are close to each other, before corona discharge occurs, spark discharge may occur between the sections 21*b* and 31*b*. However, in the dust collection device 1 of this embodiment, the position of the section 21*b* of the first electrode 21 and the position of the section 31*b* of the second electrode 31 deviate from each other by a distance d2, so that spark discharge hardly occurs between these electrodes.

In the dust collection device 1 that has such operation and effects, as described above, a thickness of each first insulating layer 22 (second insulating layer 32) of the first insulation type electrode 2 (the second insulation type electrode 3) can be set to 20 μm to 300 μm, and a thickness of the spacer 4 can be set between 0.3 mm and 5 mm, so that the entire dust collection device 1 can be formed into one sheet shape that is lightweight and thin and does not require a large space. As a result, when dust s adheres to the dust collection device 1 and the device is contaminated, the contamination can be washed out, and maintenance of the device can be easily performed.

Figure 7:
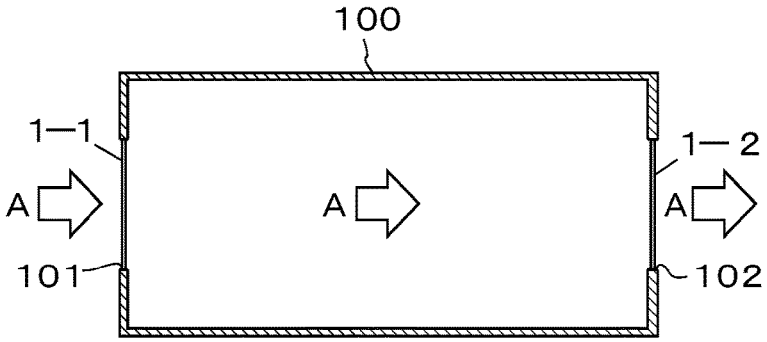
FIG. 7 is a schematic view showing a usage example of the dust collection device.

FIG. 7 is a schematic view showing a usage example of the dust collection device 1.

The dust collection device 1 according to this embodiment is structured to have one sheet shape, and suction air from the front surface and exhaust the air from the rear surface, so that the device can be installed in accordance with a window, etc., in a room.

Specifically, as shown in FIG. 7, two dust collection devices 1-1 and 1-2 are fitted airtight to two windows 101 and 102 in a room 100 so as not to allow entrance of air from other than the ventilation holes 24 (refer to FIG. 1, etc.). As this attachment, the dust collection devices 1-1 and 1-2 may be fitted into sashes (not shown) of the windows 101 and 102, or as in the case of a roller blind, the dust collection devices 1-1 and 1-2 may be fitted to window frames (not shown) so as to be drawn out and rolled up.

When the dust collection devices 1-1 and 1-2 are fitted to the windows 101 and 102 in the room 100 as described above, air A outside the room 100 passes through the dust collection device 1-1 and most of dust is removed by the dust collection device 1-1. Then, this air A flows into the room 100, and then flows out of the room 100 via the dust collection device 1-2. At this time, the air A contains dust that could not be removed by the dust collection device 1-1 and dust that originally existed in the room, however, this dust is removed by the dust collection device 1-2, and clean air A flows out of the room 100.

Therefore, air inside the room 100 is always ventilated by the dust collection devices 1-1 and 1-2. That is, fresh air A is continuously supplied into the room 100, so that an oxygen decrease in the room 100 does not occur. Air in the entire room 100 is cleaned by the dust collection device 1-2.

Further, air A cleaned by the dust collection device 1-2 flows out of the room 100, so that the air outside the room 100 is also cleaned.

Second Embodiment

Next, a second embodiment of the present invention is described.

Figure 8:
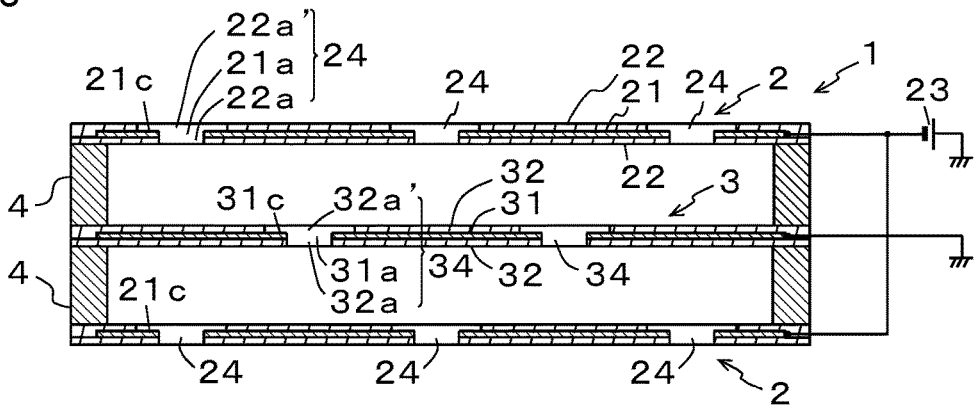
FIG. 8 is a sectional view showing a dust collection device according to a second embodiment of the present invention.

FIG. 8 is a sectional view showing a dust collection device according to a second embodiment of the present invention. FIG. 9 are plan views of insulation type electrodes, FIG. 9(*a*) shows a first insulation type electrode 2, and FIG. 9(*b*) shows a second insulation type electrode 3. FIG. 10 is a partial enlarged view of the first and second ventilation holes 24 and 34.

As shown in FIG. 8, in the dust collection device 1 of this embodiment, structures of the first and second ventilation holes 24 and 34 of the first and second insulation type electrodes 2 and 3 are different from those of the first embodiment.

Specifically, in the first ventilation hole 24 of each first insulation type electrode 2, a bore diameter of the hole 22*a*' of the upper first insulating layer 22 in the drawing is set to be larger than a bore diameter of the hole 21*a* of the first electrode 21 and a bore diameter of the hole 22*a* of the lower first insulating layer 22 in the drawing.

Accordingly, an exposed portion 21*c* of the first electrode 21 becomes an upper surface, and as shown in FIG. 9(*a*) and FIG. 10, the first electrode 21 inside the first ventilation hole 24 is exposed in a donut shape as viewed from the upper first insulating layer 22 side in the drawing.

In addition, in the second ventilation hole 34 of each second insulation type electrode 3 as well, a bore diameter of the hole 32*a*' of the upper second insulating layer 32 in the drawing is also set to be larger than a bore diameter of the hole 31*a* of the second electrode 31 and a bore diameter of the hole 32*a* of the lower second insulating layer 32 in the drawing.

Accordingly, an exposed portion 31*c* of the second electrode 31 becomes an upper surface, and as shown in FIG. 9(*b*) and FIG. 10, the second electrode 31 inside the second ventilation hole 34 is exposed in a donut shape as viewed from the upper second insulating layer 32 side in the drawing.

With this construction, by the exposed portions 21*c* and 31*c* exposed in donut shapes, the capacity for electrically charging dust is increased, so that dust attraction capacity is improved.

In this embodiment, the exposed portions 21*c* and 31*c* are formed on the upper surfaces of the first electrode 21 and the second electrode 31, however, as a matter of course, it is also possible that the exposed portions 21*c* and 31*c* are formed on lower surfaces of the first electrode 21 and the second electrode 31 by setting the bore diameters of the holes 22*a* and 32*a* of the lower first and second insulating layers 22 and 32 in the drawing to be larger than the bore diameters of the holes 21*a* and 31*a* of the first and second electrodes 21 and 31 and the bore diameters of the holes 22*a*' and 32*a*' of the upper first and second insulating layers 22 and 32 in the drawing.

Other constructions, operations, and effects are the same as those in the first embodiment described above, and description thereof is omitted.

Third Embodiment

Next, a third embodiment of the present invention is described.

Figure 13:
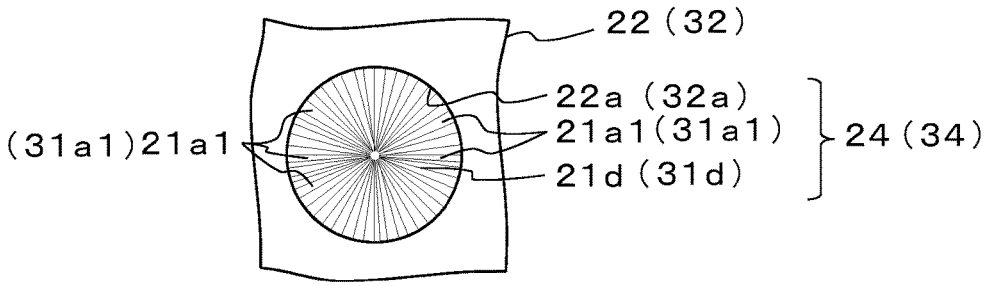
FIG. 13 is a partial enlarged view of first and second ventilation holes to be applied to the third embodiment.

FIG. 11 is a sectional view showing a dust collection device according to a third embodiment of the present invention. FIG. 12 are plan views of insulation type electrodes, FIG. 12(*a*) shows a first insulation type electrode 2 and FIG. 12(*b*) shows a second insulation type electrode 3. FIG. 13 is a partial enlarged view of first and second ventilation holes 24 and 34.

As shown in FIG. 11, in the dust collection device 1 of this embodiment, structures of the first and second electrodes 21 and 31 exposed inside the first and second ventilation holes 24 and 34 of the first and second insulation type electrodes 2 and 3 are different from those in the first and second embodiments described above.

Specifically, a part of the first electrode 21 is exposed inside the first ventilation hole 24 of the first insulation type electrode 2, and this exposed portion 21*d* is formed of conductive fibers directed toward a center side from an inner circumference of the first ventilation hole 24.

Accordingly, the exposed portion 21*d* of the first electrode 21 forms a brush-shaped electrode having a clearance 21*a*1 as a small hole as shown in FIG. 12(*a*) and FIG. 13.

On the other hand, a part of the second electrode 31 is also exposed in the second ventilation hole 34 of the second insulation type electrode 3, and this exposed portion 31*d* is formed of conductive fibers directed toward a center side from an inner circumference of the second ventilation hole 34.

Accordingly, the exposed portion 31*d* of the second electrode 31 forms a brush-shaped electrode having a clearance 31*a*1 as a small hole as shown in FIG. 12(*b*) and FIG. 13.

With this construction, by the brush-shaped exposed portions 21*d* and 31*d*, the capacity for electrically charging dust can be improved. In addition, only small dust of dust contained in air pass through the small clearances 21*a*1 of the exposed portions 21*d* and 31*d* of the first and second electrodes 21 and 31, and entrance of large dust is blocked by the brush-shaped exposed portions 21*d* and 31*d*.

Other constructions, operations, and effects are the same as those in the first and second embodiments, and description thereof is omitted.

Fourth Embodiment

Next, a fourth embodiment of the present invention is described.

Figure 14:
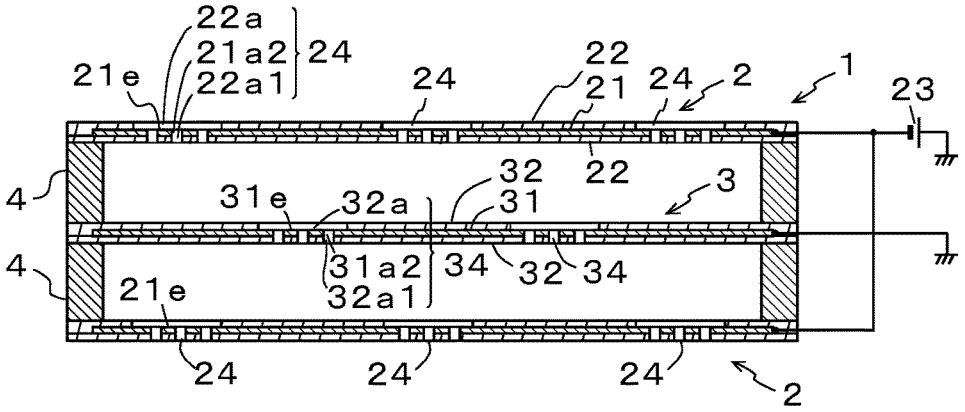
FIG. 14 is a sectional view showing a dust collection device according to a fourth embodiment of the present invention.
Figure 18A:
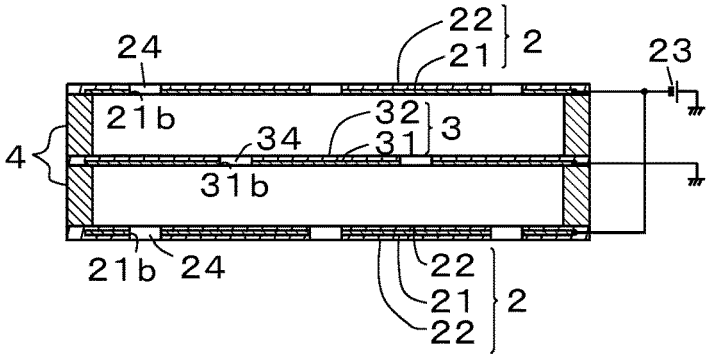
FIG. 18 are sectional views showing modifications relating to the embodiments of the present invention, FIG. 18(*a*) shows a modification of the first embodiment, FIG. 18(*b*) shows a modification of the second embodiment, FIG. 18(*c*) shows a modification of the third embodiment, and FIG. 18(*d*) shows a modification of the fourth embodiment.
Figure 18B:
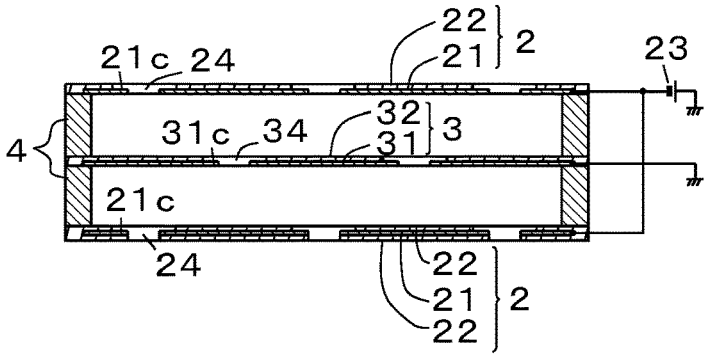
Figure 18C:
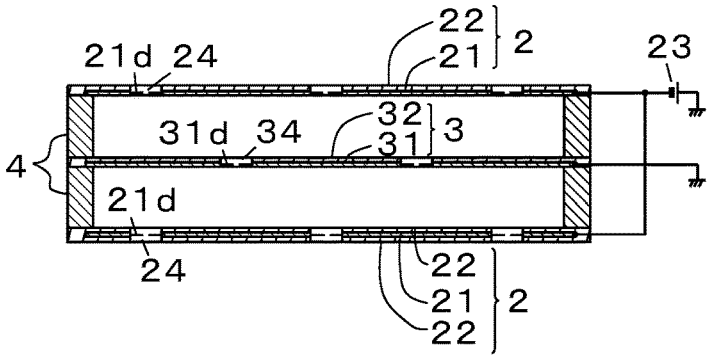
Figure 18D:
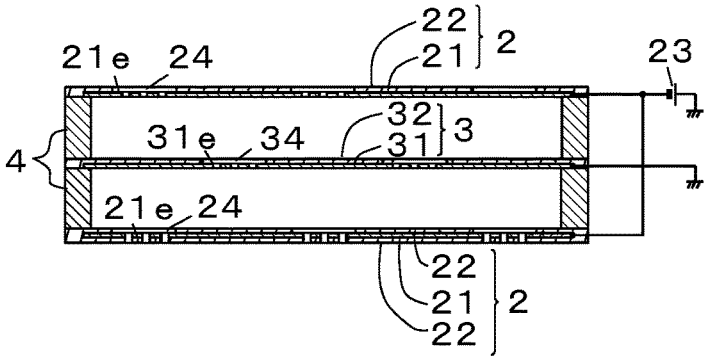

FIG. 14 is a sectional view showing a dust collection device according to a fourth embodiment of the present invention. FIG. 15 are plan views of insulation type electrodes, FIG. 15(*a*) shows a first insulation type electrode 2 and FIG. 15(*b*) shows a second insulation type electrode 3.

As shown in FIG. 14, in the dust collection device 1 of this embodiment, structures of the first and second ventilation holes 24 and 34 of the first and second insulation type electrodes 2 and 3 and structures of the first and second electrodes 21 and 31 exposed inside the first and second ventilation holes 24 and 34 are different from those of the first to third embodiments described above.

Specifically, in the first ventilation hole 24 of each first insulation type electrode 2, by setting the bore diameter of the hole 22*a* of the upper first insulating layer 22 in the drawing to be large, the first electrode 21 is exposed inside the hole 22*a*. In the exposed portion 21*e* of the first electrode 21, a plurality of small holes 21*a*2 are formed, and a plurality of small holes 22*a*1 communicating with the plurality of small holes 21*a*2 are formed in the lower first insulating layer 22 in the drawing.

Accordingly, the exposed portion 21*e* of the first electrode 21 is exposed, and as shown in FIG. 15(*a*), the plurality of small holes 21*a*2 in the exposed portion 21*e* are opened inside the large hole 22*a* of the first insulating layer 22.

In the second ventilation hole 34 of each second insulation type electrode 3 as well, by setting the bore diameter of the hole 32*a* of the upper second insulating layer 32 in the drawing to be large, the second electrode 31 is exposed inside the hole 32*a*. In the exposed portion 31*e* of the second electrode 31, a plurality of small holes 31*a*2 are formed, and a plurality of small holes 32*a*1 communicating with the plurality of small holes 31*a*2 are formed in the lower second insulating layer 32 in the drawing.

Accordingly, the exposed portion 31*e* of the second electrode 31 is exposed, and as shown in FIG. 15(*b*), the plurality of small holes 31*a*2 in the exposed portion 31*e* are opened inside the large hole 32*a* of the second insulating layer 32.

With this construction, by the exposed portions 21*e* and 31*e* of the first and second electrodes 21 and 31, the capacity for electrically charging dust can be improved. Only small dust of dust contained in air pass through the small holes 21*a*2 and 31*a*2 of the first and second electrodes 21 and 31, and entrance of large dust is blocked by the exposed portions 21*e* and 31*e* of the first and second electrodes 21 and 31.

FIG. 16 is a partial sectional view showing a modification relating to the first ventilation hole 24 (second ventilation hole 34) of the first insulation type electrode 2 (second insulation type electrode 3), and FIG. 17 is a partial sectional view showing another modification relating to the first ventilation hole 24 (second ventilation hole 34) of the first insulation type electrode 2 (second insulation type electrode 3).

In the embodiment described above, as shown in FIG. 14, a construction in which in the first ventilation hole 24 (second ventilation hole 34) of the first insulation type electrode 2 (second insulation type electrode 3), the bore diameter of the hole 22*a* (hole 32*a*) of the upper first insulating layer 22 (second insulating layer 32) in the drawing is set to be large, and the plurality of small holes 22*a*1 (holes 32*a*1) are formed in the lower first insulating layer 22 (second insulating layer 32) in the drawing is illustrated, however, as shown in FIG. 16, as a matter of course, the same operation and effects can be obtained even in the case where holes 22*a* (holes 32*a*) having the same shapes as the holes 22*a* (holes 32*a*) of the upper first insulating layer 22 (second insulating layer 32) in the drawing are also provided in the lower first insulating layer 22 (second insulating layer 32) in the drawing.

As shown in FIG. 17, even in a case where the exposed portion 21*e*1 inside the hole 22*a* (32*a*) is formed in a meshed pattern to form a number of small holes 21*a*2 (31*a*2), the same operation and effects can be obtained.

Other constructions, operations, and effects are the same as those of the first to third embodiments described above, so that description thereof is omitted.

(Modification)

Next, modifications of the first to fourth embodiments described above will be described.

FIG. 18 are sectional views showing modifications relating to the embodiments of the present invention, and FIG. 18(*a*) shows a modification of the first embodiment, FIG. 18(*b*) shows a modification of the second embodiment, FIG. 18(*c*) shows a modification of the third embodiment, and FIG. 18(*d*) shows a modification of the fourth embodiment.

In the first to fourth embodiments described above, as shown in FIG. 3, FIG. 8, FIG. 11, and FIG. 14, each first insulation type electrode 2 (second insulation type electrode 3) is formed by coating both surfaces of the first electrode 21 (second electrode 31) by the first insulating layers 22 (second insulating layers 32).

However, the structure of each first insulation type electrode 2 (second insulation type electrode 3) is not limited to that formed by coating both surfaces of the first electrode 21

(second electrode 31) by the first insulating layers 22 (second insulating layers 32).

That is, in the first to fourth embodiments, as shown in FIG. 18(*a*) to FIG. 18(*d*), the first insulation type electrode 2 (second insulation type electrode 3) may be constructed by coating only the upper surface of the first electrode 21 (second electrode 31) in the drawing by the first insulating layer 22 (second insulating layer 32), or coating only the lower surface of the first electrode 21 (second electrode 31) in the drawing by the first insulating layer 22 (second insulating layer 32). In FIG. 18, both surfaces of the first electrode 21 in the lowermost first insulation type electrode 2 are coated by first insulating layers 22, however, also in this lowermost first insulation type electrode 2, one surface of the first electrode 21 may be coated by the first insulating layer 22.

Other constructions, operations, and effects are the same as those of the first to fourth embodiments, and description thereof is omitted.

The present invention is not limited to the embodiments described above, and can be variously modified and changed within the spirit and scope of the present invention.

For example, in the above-described embodiments, as a first voltage, a negative voltage of −6 kV is applied to the first electrodes 21, and as a second voltage, a voltage of 0 kV is applied to the second electrode 31, however, the first and second voltages are not limited to these. The first and second voltages are arbitrary voltages as long as they are different in potential from each other and cause a potential difference between the first electrode and the second electrode.

In the embodiments described above, each of the second ventilation holes 34 is disposed so as to be positioned at substantially the center between two first ventilation holes 24 adjacent to each other provided in the first insulation type electrode 2, however, each second ventilation hole 34 is only required to deviate by a predetermined distance from the first through hole 24, and the deviation amount is arbitrary.

The total number of the first and second insulation type electrodes 2 and 3 and the total number of the first and second ventilation holes 24 and 34 are arbitrary.

The first embodiment described above shows an example in which, as shown in FIG. 6, the dust collection units 1 are fitted to the windows 101 and 102 in the room 100 and used, however, as another usage example, it is also possible that the dust collection device 1 is attached to or hung down from a flight vehicle so as to automatically clean air in a desired space while flying. By forming the dust collection device 1 so that it can be held by hand, it becomes possible for the dust collection device to clean air in a desired space while being carried around.

In the embodiments described above, as shown in FIG. 19(*a*), each of the second ventilation holes 34 of the second insulation type electrode 3 is disposed so as to be positioned at substantially the center between two first ventilation holes 24-1 and 24-2 adjacent to each other in a lateral direction in the drawing of the first insulation type electrode 2 in a planar view.

However, the term "adjacent to each other" means not only an adjacent state in a lateral direction in the drawing. That is, the term "adjacent to each other" also includes adjacent to each other in a diagonal direction and a vertical direction in the drawing. Therefore, as shown in FIG. 19(*b*), a case where each of the second ventilation holes 34 is disposed so as to be positioned at substantially the center between two first ventilation holes 24-1 and 24-2 adjacent to each other in a diagonal direction in the drawing is also included.

Figure 19A:
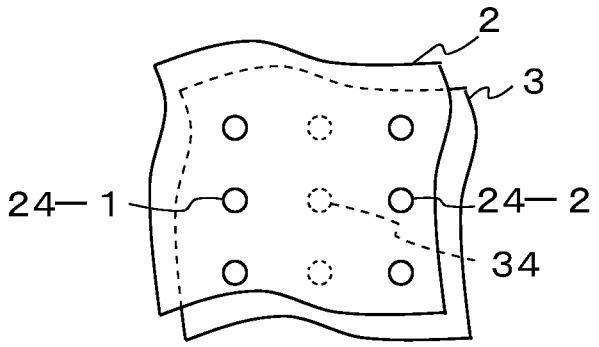
FIG. 19 are partial plan views showing disposition examples of the first and second ventilation holes, FIG. 19(*a*) shows a disposition example applied to the embodiments, FIG. 19(*b*) shows a modification of the disposition example, and FIG. 19(*c*) shows another modification of the disposition example.
Figure 19B:
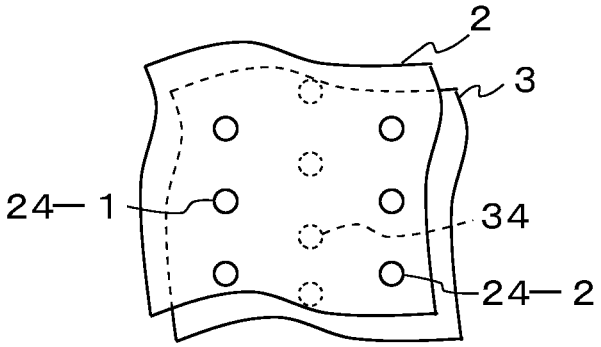
Figure 19C:
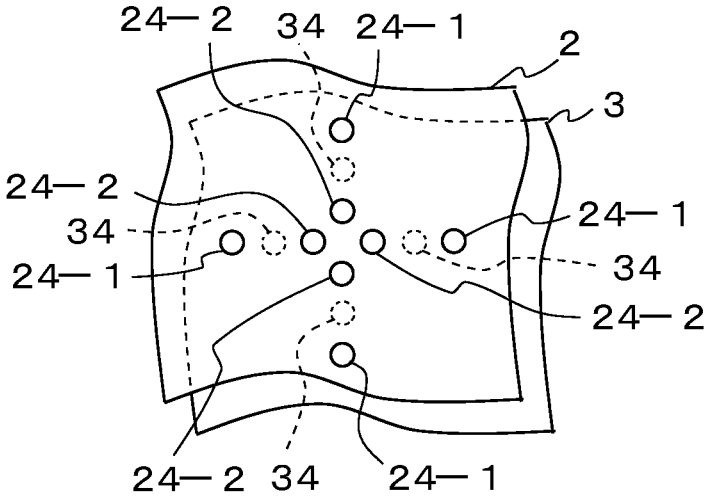

Further, as shown in FIG. 19(*c*), it is also possible that the first ventilation hole group 24-1, the second ventilation hole group 34, and the first ventilation hole group 24-2 are disposed concentrically, and each of the second ventilation holes 34 is positioned at substantially the center between two first ventilation holes 24-1 and 24-2 adjacent to each other in a lateral direction or a vertical direction.

In the dust collection device according to the present embodiment, as described above, by disposing each of the second ventilation holes of the second insulation type electrode so as to be positioned at substantially the center between two first ventilation holes adjacent to each other of the first insulation type electrode in a planar view, spark discharge can be more effectively prevented. However, the present invention is not limited only to a dust collection device including first and second ventilation holes disposed as described above, and a dust collection device in which second ventilation holes are disposed so that positions of the second ventilation holes deviate by a predetermined distance from positions of the first ventilation holes in a planar view is also included within the scope of the present invention.

In the embodiments described above, a direct current power supply is illustrated as a power supply 23, however, an alternating current power supply or a pulsed power supply can also be used.

REFERENCE SIGNS LIST

1, 1-1, 1-2 . . . dust collection device, 2, 2-1, 2-2 . . . first insulation type electrode, 3 . . . second insulation type electrode, 4 . . . spacer, 21 . . . first electrode, 21*a*, 21*a*1 21*a*2, 22*a*, 22*a*', 22*a*1, 31*a*, 31*a*1, 31*a*2, 32*a*, 32*a*', 32*a*1 . . . hole, 21*b*, 31*b* . . . section, 21*c*, 21*d*, 21*e*, 21*e*1, 31*c*, 31*d*, 31*e*, 31*e*1 . . . exposed portion, 22 . . . first insulating layer, 23 . . . power supply, 24, 24-1, 24-2 . . . first ventilation hole, 31 . . . second electrode, 32 . . . second insulating layer, 34 . . . second ventilation hole, 100 . . . room, 101, 102 . . . window, A . . . air, s . . . dust.

The invention claimed is:

1. A dust collection device comprising:

a first insulation type electrode including a first sheet-shaped electrode having at least one surface is coated with a first insulating layer, a first voltage being applied to the first sheet-shaped electrode, and a second insulation type electrode including a second sheet-shaped electrode having at least one surface coated with a second insulating layer, a second voltage different from the first voltage being applied to the second sheet-shaped electrode, the second insulation type electrode being laminated with the first insulation type electrode via an insulating spacer, wherein provided in the first insulation type electrode is a plurality of first ventilation holes penetrating from the first insulating layer to the first sheet-shaped electrode and exposing a part of the first sheet shaped electrode inside, provided in the second insulation type electrode is a plurality of second ventilation holes penetrating from the second insulating layer to the second sheet-shaped electrode and exposing a part of the second sheet shaped electrode inside, and the second ventilation holes are disposed and positioned to deviate by a predetermined distance from the first ventilation holes in a plan view.

2. The dust collection device according to claim 1, wherein the first sheet-shaped electrode inside each of the first ventilation holes is exposed in a donut shape as viewed from the first insulating layer side, and the second sheet-shaped electrode inside each of the second ventilation holes is exposed in a donut shape as viewed from the second insulating layer side.

3. The dust collection device according to claim 1, wherein the first sheet-shaped electrode inside each of the first ventilation holes is formed into a brush-shaped electrode made of conductive fibers directed toward a center side from an inner circumference of the first ventilation hole, and the second sheet-shaped electrode inside each of the second ventilation holes is formed into a brush-shaped electrode made of conductive fibers directed toward a center side from an inner circumference of the second ventilation hole.

4. The dust collection device according to claim 1, wherein a plurality of small holes is formed in the sheet-shaped first electrode inside each of the first ventilation holes, and a plurality of small holes is formed in the second sheet-shaped electrode inside each of the second ventilation holes.

5. The dust collection device according to claim 1, wherein the first insulating layer is coated on each of two surfaces of the first sheet-shaped electrode of the first insulation type electrode, the second insulating layer is coated on each of two surfaces of the second sheet-shaped electrode of the second insulation type electrode, the first ventilation holes penetrate across the first insulating layer on each side of the first sheet-shaped electrode in a state that a part of the first sheet-shaped electrode exposes inside, and the second ventilation holes penetrate across the second insulating layer on each side of the second sheet-shaped electrode in a state that a part of the second sheet-shaped electrode inside.

6. The dust collection device according to claim 1, wherein the first voltage with a positive potential or a negative potential is applied to the first sheet-shaped electrode, and the second voltage with zero potential is applied to the second sheet-shaped electrode.

7. The dust collection device according to claim 1, wherein each of the second ventilation holes is disposed so as to be positioned at substantially a center between two of the first ventilation holes adjacent to each other provided in the first insulation type electrode in a plan view.

* * * * *